US005271201A

United States Patent [19]

Noone et al.

[11] Patent Number: 5,271,201

[45] Date of Patent: Dec. 21, 1993

[54] HIP OR RIDGE SHINGLE

[75] Inventors: Michael J. Noone, Wayne; Kermit E. Stahl, North Wales, both of Pa.

[73] Assignee: CertainTeed Corporation, Valley Forge, Pa.

[21] Appl. No.: 899,343

[22] Filed: Jun. 16, 1992

[51] Int. Cl.[5] ..... E04D 1/00; E04D 1/30; E04B 7/02

[52] U.S. Cl. ..... 52/518; 52/57; 52/420; 52/555

[58] Field of Search ..... 52/57, 528, 518, 417, 52/416, 420, 554, 555, 557, 518

[56] References Cited

U.S. PATENT DOCUMENTS

| | | | |
|---|---|---|---|
| 993,686 | 5/1911 | Howard | 52/417 |
| 1,795,913 | 3/1931 | Weaver | 52/518 |
| 1,989,554 | 1/1935 | Kirschbraun et al. | 52/518 |
| 2,289,699 | 7/1942 | Doe | 52/528 |
| 3,252,257 | 5/1966 | Price et al. | 52/420 |
| 3,913,294 | 10/1975 | Freiborg . | |
| 3,921,358 | 11/1975 | Bettoli | 52/555 |
| 4,404,783 | 9/1983 | Freiborg . | |
| 4,434,589 | 3/1984 | Freiborg . | |
| 4,717,614 | 1/1988 | Bondoc et al. | 52/555 |
| 4,835,929 | 6/1989 | Bondoc et al. . | |
| 5,094,042 | 3/1992 | Freborg . | |

FOREIGN PATENT DOCUMENTS

| | | | |
|---|---|---|---|
| 2455659 | 1/1981 | France | 52/416 |

*Primary Examiner*—Carl D. Friedman
*Assistant Examiner*—Christopher T. Kent
*Attorney, Agent, or Firm*—Paul & Paul

[57] ABSTRACT

A shingle is provided that is especially adapted for application to hips or ridges of a roof. In a preferred embodiment, the shingle is a laminated multi-layer shingle, adapted to be bent or curled in the installed condition. The shingle layers are connected together in one zone, and are otherwise adapted to slide relative to another as the shingle is bent or curled, yet are adapted to be connected to each other in another zone after being bent or curled. Preferably, such connection is by means of an adhesive, and even more preferably, a release strip is provided between the adhesive in the other zone and an adjacent shingle portion, to permit sliding of the laminated layers relative to each other as they are bent or curled. The release strip that permits the sliding may either be removable or captured between the laminated layers. In another embodiment, an alignment feature is provided at the junction of the tab and headlap portion of the shingle, for visual alignment of a bottom edge of a tab of an overlying shingle with a locating zone at the upper end of the tab of a next-subjacent shingle, as the shingles are being laid up. In the case of a laminated multi-layer shingle, such alignment feature can reside in a cut-back portion of an upper layer of the shingle having a configuration that is the same as a corner of the lower edge of the tab portion of the shingle.

21 Claims, 3 Drawing Sheets

HIP OR RIDGE SHINGLE

BACKGROUND OF THE INVENTION

In the art of shingle manufacture and use, it is commonplace that shingles are laid up onto a roof in courses or rows, generally with successive rows being staggered relative to each other. As courses approach the apex of a roof, commonly referred to as the "ridge", and generally from each side of the ridge, the shingling of the ridge itself has generally required separate treatment. Similarly, in roofing other surfaces of roofs, such as dormers, or even different types of roofs, there are places where different planes come together that are not ridges, but are called "hips". Hips can occur, for example, at the lines of intersection of the various planes of a pyramid-shaped structure. In each of these circumstances, whether it involves shingling a ridge or shingling a hip, it is necessary that the shingle be bent or curled around the hip or ridge, partially covering each of the planes that make up the hip or ridge.

Conventionally, therefore, the shingles that effect such covering are called "hip or ridge" shingles. Hip or ridge shingles have often been prepared on the building site by roofers, simply by cutting a portion of a conventional shingle. Typically, if a roof is being covered with shingles, particularly three-tab or four-tab shingles, the roofer will cut a shingle through the headlap portion, continuing the separation provided by the precut slots between adjacent tabs of a shingle, thereby yielding hip or ridge shingles each the width of a single tab, and having a lower tab portion and an upper headlap portion. The hip or ridge would then be conventionally covered by laying up such shingles such that the tab portions are visible, with each next-applied shingle having its tab portion covering the headlap portion of a previously applied shingle.

As styles in general have changed, particularly to provide roofs with different aesthetic effects, but often to provide roofs with improved protection from the elements, the use of laminated multi-layer shingles has increased. A multi-layer shingle in the art is a shingle that is comprised of at least two complete shingle layers; that is, each shingle layer as a minimum would have a base mat generally either of rag or fiberglass construction, with asphaltic material applied, generally to both sides with the mat embedded in the asphaltic material, and a covering of granules, at least on the upper surface, but also with a coating of another substance, perhaps mica, on the lower surface. The asphaltic material is generally a material having a bitumin base. Such complete layers of shingle material can have other laminae as components of their interior construction, but will at least generally have a base mat, a layer of asphaltic material, and a layer of granules. In constructing a laminated shingle, two or more such layers of complete shingle material are connected together, generally by means of an adhesive disposed between the layers, which adhesive will often generally also be an asphaltic material.

In laminating shingles together, the adhesive between adjacent layers can cover the entire superimposed surfaces, or can be applied in spaced-apart locations between the superimposed surfaces of the shingle layers, so that a given multi-layer shingle can be applied in a single shingling application, much the same way as one would apply a single layer shingle to a roof.

In endeavoring to use cut-up tab portions of a multi-layer shingle as hip and ridge shingles, it has been found that the bending or curling of such shingles can lead to cracking or wrinkling of at least one of the layers of the multi-layer shingle.

One effort to solve the problem has resulted in making special hip or ridge shingles rather than cutting them on the building site from the regular roofing shingles. Such special hip or ridge shingles have been made with a line of adhesive connecting the upper and lower layers and running vertical on the shingle so that when the shingle is bent around a hip or ridge, the line of adhesive will be more or less aligned with the hip or ridge, and with portions of the hip or ridge shingle on opposite sides of the bend then being secured to the surfaces of the roof on opposite sides of the hip or ridge. However, because such a shingle is bent, the uncovered tab portions of the upper layer of shingle may tend to stick up into the air, presenting risks of being caught by wind and ripped away from the roof. In order to overcome that particular problem, an adhesive can be applied at the site, to secure such tab portions of upper layers of the shingles on opposite sides of the hip or ridge, down into contact with the shingle's lower layer. Such a solution to the problem of wrinkling or cracking of these shingles, however, requires that additional labor-intensive procedure; namely, on-site sealing with an adhesive.

Furthermore, in applying hip or ridge shingles in general, care must be taken to provide the proper spacing for the visible portions of the shingles; i.e., to allow just the right amount of tab portion of the shingle to be exposed, without the benefit of being guided by a full course of shingles, as is present when applying full size shingles by courses to sloped surfaces of a roof.

SUMMARY OF THE INVENTION

The present invention addresses the problems set forth above by providing a laminated multi-layer shingle, in which the layers are connected in one zone, allowing the other portions of the multi-layer shingle to slide relative to each other as the shingle is bent or curled upon being applied to cover a hip or ridge, but yet allowing at least one such other portion or zone of the layers of a shingle to become connected after being so bent or curled. Such latter connection can be in the form of an adhesive connection after uncovering the adhesive by means of a release strip. The release strip can either be removed from an adhesive zone after the bending or curling of the shingle, such that the adhesive, while being adhered to one of the shingle layers is then free to adhere to the other shingle layer, or the release sheet may remain captured between the layers, but only being moved a sufficient amount by the bending or curling, to at least partially uncover an adhesive zone so that the adhesive may then connect two layers of shingle.

Additionally, a visual alignment guide is provided at the junction of tab and headlap portion of the shingle, for alignment with the lower edge of a next-applied shingle, in order to assure proper spacing of shingles. Such visual alignment, in the case of a multi-layer laminated shingle, may reside in having a cut-back portion of the top layer, configured to be parallel to a lower corner of that shingle, so as to present a locating zone for each newly applied shingle.

OBJECTS OF THE INVENTION

Accordingly, it is a primary object of the present invention to provide a novel multi-layer laminated hip or ridge shingle whereby in the installed condition of the shingle, bent or curled around a hip or ridge, portions of the multi-layer shingle on each side of the hip or ridge are laminated together between the layers, without wrinkling or cracking of either shingle layer.

It is a further object to accomplish the above object, in which a release member, strip, paper, etc. prevents an adhesive that is disposed between two layers of shingle, from connecting the two layers of shingles together at that location, but wherein the release member may be moved or removed when the shingle is curled or bent upon application to a roof, leaving the adhesive at that location to connect together the shingle layers at that location.

It is a further object of this invention to provide a locating mechanism, whereby hip or ridge shingles may be located with the proper spacing of uncovered tab portions.

It is another object of this invention to accomplishing the foregoing object in a two-layer shingle by means of providing a ready alignment of a lower edge of the shingle with a cut-back in the tab portion of a top layer of the shingle, at the junction of its tab and headlap portions.

Other objects and advantages of the present invention will be readily apparent upon a reading of the following brief descriptions of the drawing figures, detailed descriptions of the preferred embodiments and the appended claims.

BRIEF DESCRIPTIONS OF THE DRAWING FIGURES

DETAILED DESCRIPTION OF THE PREFERRED EMBODIMENTS

Figure 1:
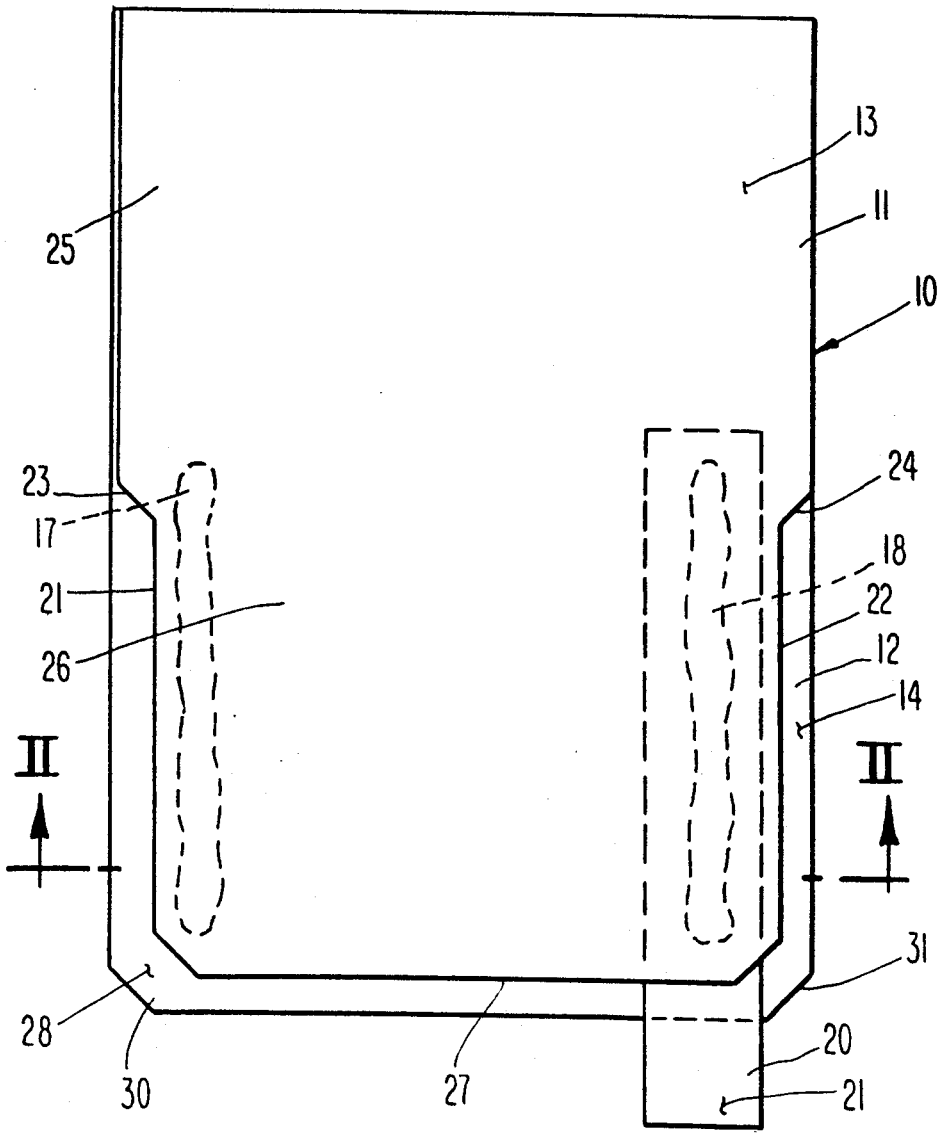
FIG. 1 is a top plan view of a laminated multi-layer hip or ridge shingle, wherein an adhesive zone is shown in dotted line connecting the layers together on the left side, and wherein an adhesive zone and a release strip are shown located between the shingle layers on the right side.

Referring now to the drawings in detail, reference is first made to FIG. 1, wherein a laminated multi-layer shingle 10 is illustrated in the form of a hip-and-ridge shingle, as comprising an upper layer 11 and a lower layer 12, each of complete shingle material. That is, each layer 11 and 12 is comprised of a base mat covered, preferably by being embedded in an asphaltic "bitumin" material and having a layer of granules on each upper surface 13, 14. Lower surfaces 15, 16 will also generally be provided with a layer of finer granular material, such as mica or the like applied thereto. The upper and lower layers 11, 12 are secured together in connected relation by means of a vertical strip 17 of adhesive material secured to the under surface 15 of layer 11 and to the upper surface 14 of layer 12, as illustrated in dotted line at the left of FIG. 1. At the right of FIG. 1, a vertical layer of adhesive 18 is secured to the under surface 15 of shingle layer 12, with the adhesive 18 also preferably being of an asphaltic material, but with the adhesive 18 being unsecured to the upper surface 14 of lower layer 12, due to the presence of a removable strip of release paper 20, sandwiched between the adhesive strip 18 and the subjacent portion of the surface 14 of layer 12. The release strip 20, of release paper or like construction, will generally have a slick or glossy upper surface 21, constructed of a conventional material that would make it readily detachable from the adhesive 18.

It will be noted that the upper layer 11 of the shingle 10 has a cut-back portion 21 on the left side, and another cut-back portion 22 on the right side, with such cuts being generally vertically disposed and terminating in sloped lines 23, 24, respectively, at the junction of the upper or headlap portion 25 of the shingle 10, with the tab portion 26, thereof. It will also be noted that the lower edge of the upper shingle layer 10 has a cut-back portion 27, leaving a U-shaped zone 28 of the tab portion of the lower shingle 12 framing the tab portion of the upper shingle 11, as shown in FIG. 1.

It will further be noted that the sloped lines 23, 24, formed at said cut-back portions are configured the same as the lower left and right corners 30, 31 of the lower layer 12, to be respectively parallel therewith.

Figure 2:
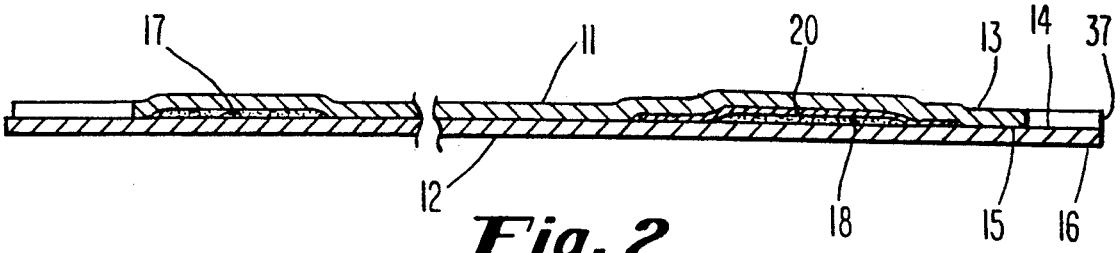
FIG. 2 is an enlarged fragmentary horizontal transverse sectional view of the shingle of FIG. 1, taken generally along the line II—II of FIG. 1.
Figure 3:
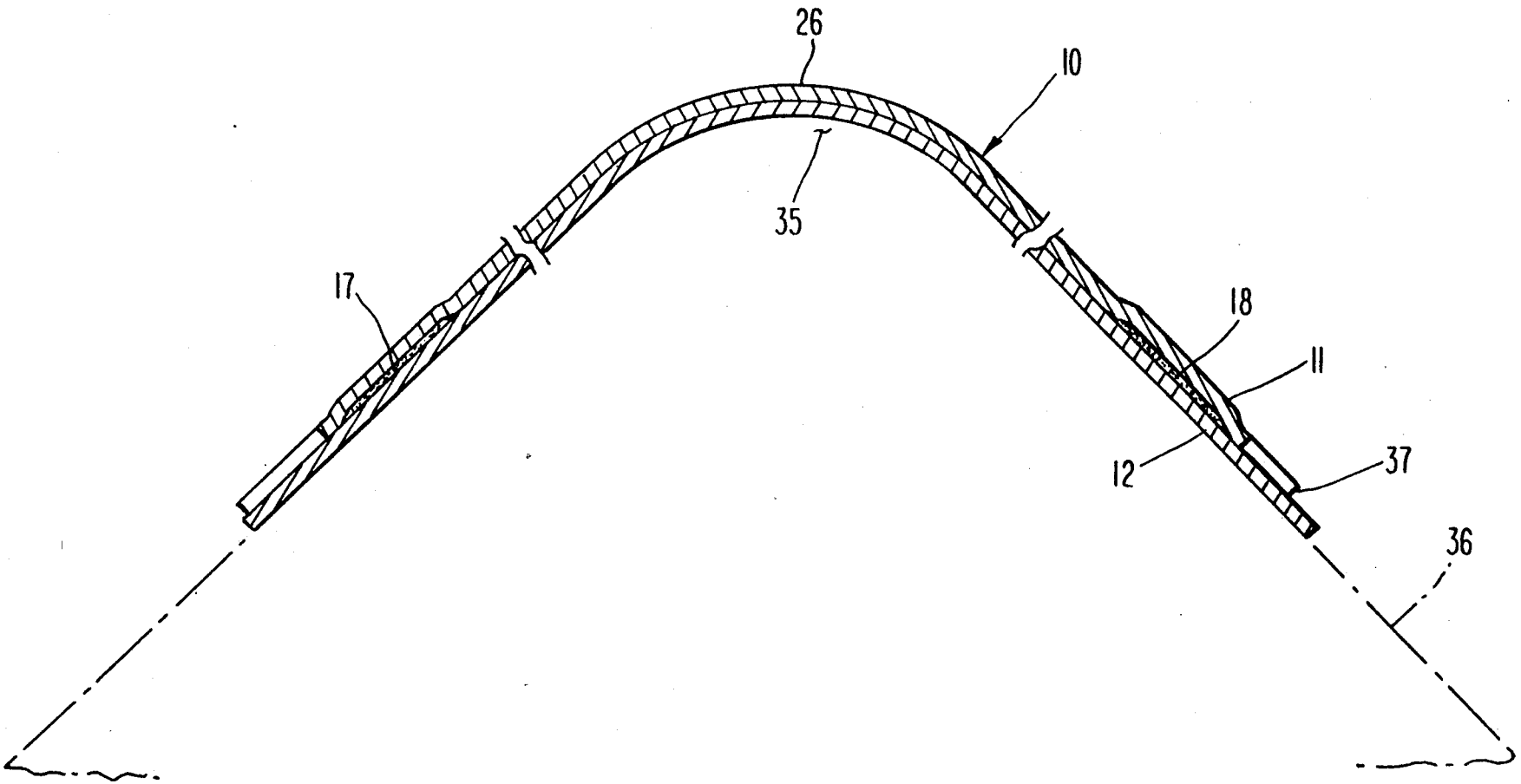
FIG. 3 is a view similar to that of FIG. 2, but wherein the shingle has been bent or curled and applied to a roof hip or ridge, which hip or ridge is illustrated in phantom in FIG. 3.

With reference to FIG. 3, it will be seen that the shingle 10 is disposed bent or curled around a ridge or hip 35 of a roof 36 (shown in phantom), and that strip 20 of release material has been removed, such that the adhesive 18 is enabled to connect together the layers 11 and 12 in the zone of each in which the adhesive 18 is present, just as does the adhesive strip 17 connect together the layers 11 and 12 likewise in the zone in which the adhesive 17 is present. By reference to the right side of each of FIGS. 2 and 3, it will be seen that the right edge 37 of the upper shingle layer 11 moves leftward as the layers 11 and 12 are curled or bent, from the position illustrated in FIG. 2, to that illustrated in FIG. 3, to allow take-up of the material to accommodate the curling or bending.

It will thus be seen, that in the installed condition as illustrated in FIG. 3, the tab portion 26 of the shingle will have left and right sides of its upper layer 11, securely connected to the corresponding left and right sides of the underlying shingle layer 12, at both zones 17 and 18, in order to hold that tab portion down, tightly against the lower shingle layer 12.

Figure 4:
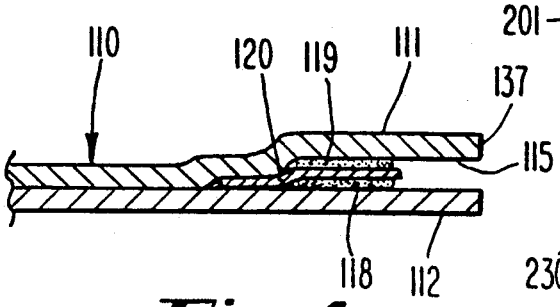
FIG. 4 is an enlarged fragmentary transverse view similar to the right side of FIG. 2, but wherein an alternative adhesive and release strip arrangement is illustrated prior to the shingle being bent or curled.
Figure 5:
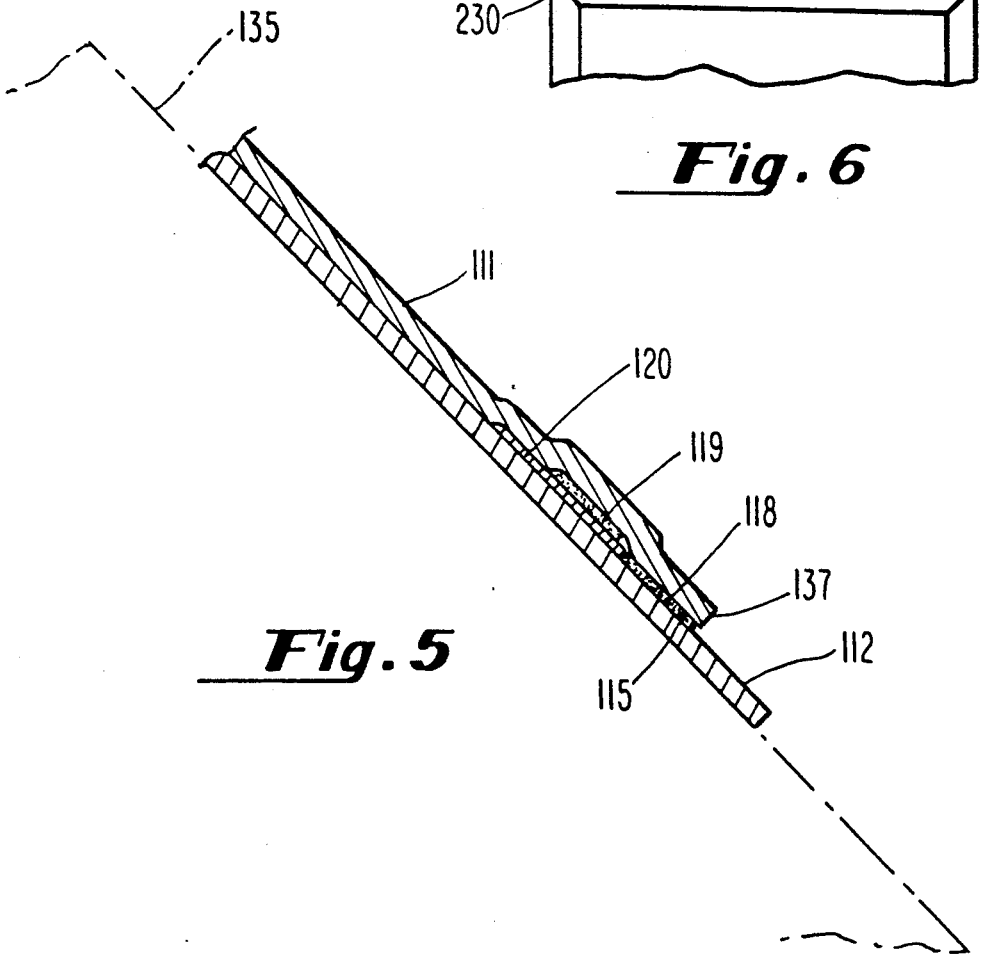
FIG. 5 is a view similar to that of FIG. 4, but wherein the shingle has been bent or curled upon application to a ridge or hip, such that there is relative movement between the two shingle layers as illustrated in FIG. 5, compared to the illustration in FIG. 4.

With reference now to FIGS. 4 and 5, it will be seen that upper and lower shingle layers 111, 112, of the right side of a shingle like that of FIG. 1, are provided with an alternative release member of a form of a release strip 120, securely fastened to the underside 115 of layer 111 by means of an adhesive 119, such that the release strip 120 will be carried by and move with the adhesive 119 and with layer 111. Consequently, when the shingle 110 is bent or curled around a peak or ridge (not shown) of a roof 135, the unsecured-together portions of the layers 111, 112 illustrated in FIG. 4 for the shingle 110, slide relative to each other, such that the release strip 120 is moved away from the overlying relation shown in FIG. 4 relative to adhesive strip 118, to expose the adhesive strip 118 to the underside 115 of upper layer 111, whereby the adhesive strip 118 connected to and securely carried by the lower layer 112 will be now become adhered to the underside 115 of upper layer 111 as well, connecting the upper an layers 111, 112 together, as shown in FIG. 5.

The sliding movement effected by the relative movement of layers 111 and 112 between FIGS. 4 and 5, is represented by the movement of the right end 137 of upper layer 111, relative to lower shingle layer 12.

Figure 6:
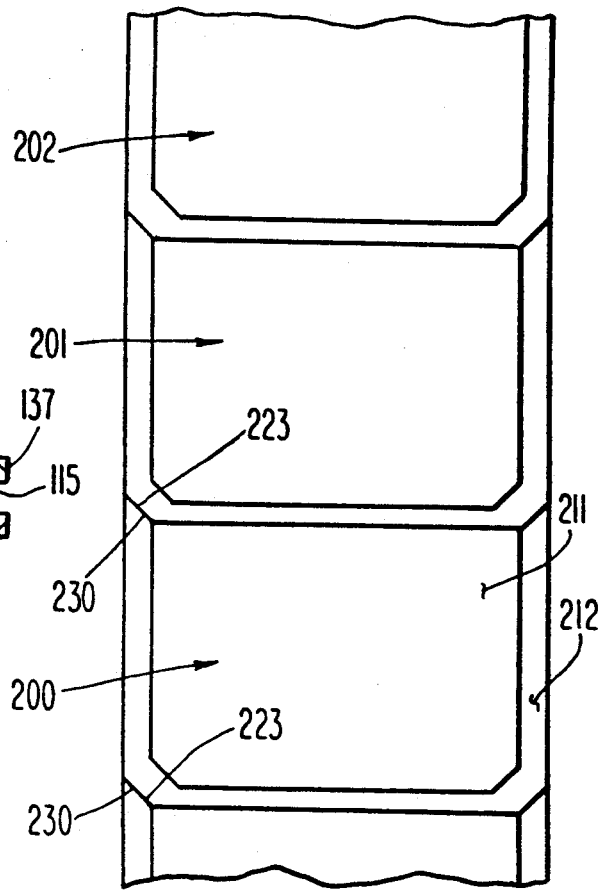
FIG. 6 is a fragmentary illustration of a plurality of laid-up hip and ridge shingles, wherein the alignment-/locating feature of this invention is illustrated.

With reference to FIG. 6, another aspect of the invention is illustrated, in which a plurality of shingles 200, 201, 202 each having upper and lower layers 211, 212, respectively, are illustrated, in laid-up condition on the hip or ridge of a roof, and wherein the alignment-/locating means of the present invention are illustrated. In laying up the shingles in FIG. 6, it will be noted that the lower left corner 230, is sloped in the same manner as is the cut-back juncture or transition portion 223 of the upper layer 211 of each shingle, similar to the manner discussed above in FIG. 1, such that merely aligning the edges 223, 230 (like the edges 23, 30 in FIG. 1), allows one to locate the lower left corner of a newly applied shingle, such as 201 in covering relation to the headlap portion (not shown) of a next subjacent shingle 200, leaving the complete tab portion of the shingle 20 exposed as intended, with the sloped lines 223, 230, aligned one above the other. This will leave the proper spacing of all shingles 200, 201, 202, etc., relative to each other.

It will be apparent from the foregoing that various modifications may be made in the details of construction, as well as in the use and operation of shingles in accordance with the present invention, all within the spirit and scope of the invention as claimed. For example, hip and ridge shingles may be used in accordance with the present invention, in a reverse bend situation, so as to accommodate shingling valleys formed where different planes of roof come together. Moreover, the sliding aspect of the present invention between upper and lower layers of a multi-layer shingle is applicable to shingles other than hip and ridge shingles; for example, with standard multi-layer shingles, wherever tight bends or turns are to be used for such shingles. In this regard, in shingling over arches of tight dimension, bulges, etc., it will be understood that the present invention is applicable for full size shingles, multi-tab shingles, etc. It will also be understood that a plurality of slide zones 18 of connectable adhesive may be utilized in accordance with the present invention, and that such adhesive zones need not be unbroken, in that they could be dots or spots of adhesive, if desired. It will also be understood that such adhesive zones could be multiple throughout the layers of overlap of the shingle, in either or both of the headlap and/or tab portion, along either or both sides, along the bottom of the overlying shingle portions, etc. It will also be understood that different types of adhesive other than asphaltic adhesives may be used with the present invention, and even other types of connections between shingle layers. It will also be understood that the present invention is not restricted to a removable release strip 20 or a captured release strip 120, as illustrated, in that other arrangements or combinations thereof, including optionally removable release strips may be utilized.

It will further be understood that while the slanted edges 223, 230 or 23, 30 constructed to be parallel to each other for aligning and locating one shingle relative to another are desirable, that other forms of locating and indicia may also be utilized, to effect proper placement of one hip and ridge shingle relative to another.

Accordingly, it will be seen that the present invention is as set forth in the appended claims.

We claim:

1. A laminated multi-layer shingle of generally flat configuration prior to installation and adapted to be bent or curled into an at least partially arcuate configuration in its installed condition, said shingle having at least two layers with first securement means securing the at least two layers together in a first connected zone in their generally flat configuration prior to installation, with portions of the at least two layers of shingle material other than the first connected zone being adapted to slide relative to each other as the multi-layer shingle is bent or curled into an at least partially arcuate configuration, and with a second securement means, carried by and connected to one said layer in the flat condition of said layer prior to installation in a second zone between said layers, and comprising means for leaving said layers unconnected to each other in said second zone in the generally flat configuration of the multi-layer shingle, and whereby the said layers may be connected to each other forming a second connected zone in the bent or curled configuration of the multi-layer shingle.

2. The shingle of claim 1, wherein said second securement means includes an adhesive material.

3. The shingle of claim 2, wherein said second securement means includes a release strip between said layers in said second zone.

4. A laminated multi-layer shingle of generally flat configuration prior to installation and adapted to be bent or curled into an at least partially arcuate configuration in its installed condition, said shingle being of at least two layers of complete shingle material, wherein each layer of complete shingle material is comprised of a base mat with a covering of asphaltic material applied thereto and a covering of granules applied to the asphaltic material, with first securement means securing the at least two layers of shingle material together in a first connected zone in their generally flat configuration prior to installation, with portions of the at least two layers of shingle material other than the first connected zone being adapted to slide relative to each other as the multi-layer shingle is bent or curled into an at least partially arcuate configuration, and with a second securement means, carried by and connected to one said layer of shingle material in the flat configuration of said layer prior to installation in a second zone between said layers of shingle material, and comprising means for leaving said layers of shingle material unconnected to each other in said second zone in the generally flat configuration of the multi-layer shingle, and whereby the said layers of shingle material may be connected to each other forming a second connected zone in the bent or curled configuration of the multi-layer shingle.

5. The shingle of claim 4, wherein said second securement means includes an adhesive material.

6. The shingle of claim 5, wherein said second securement means includes a release strip between the layers of shingle material in said second zone.

7. The shingle of claim 6, wherein said release strip is removable from said second zone to leave the adhesive material in said second zone to become connected to the other said layer of shingle material at said second zone.

8. The shingle of claim 6, wherein said release strip is disposed to comprise means slidable over at least part of said second adhesive securement means as the multi-layer shingle is bent or curled for installation, leaving at least part of said second adhesive securement means to contact and become connected to the other said layer of shingle material at said second zone.

9. The shingle of claim 4, wherein said multi-layer shingle comprises a tab portion adapted to be exposed in the installed condition and having opposite side edges and a lower edge, and a headlap portion adapted to be covered in the installed condition, and wherein said first connected zone is in the tab portion of the multi-layer shingle.

10. The shingle of claim 9, wherein said first connected zone comprises an elongate zone generally perpendicular to the lower edge of the tab portion.

11. The shingle of claim 10, wherein said first connected zone is along one side of a said tab side edge.

12. The shingle of claim 11, wherein said second zone is along the opposite said tab side edge.

13. The shingle of any one of claims 4-12, wherein said multi-layer shingle comprises a hip or ridge shingle.

14. The shingle of claim 13, wherein said multi-layer shingle is of single tab width.

15. A laminated multi-layer hip or ridge shingle of generally flat configuration prior to installation and adapted to be bent or curled into an at least partially arcuate configuration in its installed condition partially over an overlain shingle and partially covered by a next-overlying shingle, said shingle being of at least upper and lower layers of complete shingle material, wherein each layer of complete shingle material is comprises of a base mat with a covering of asphaltic material applied thereto and a covering of granules applied to the asphaltic material, with means securing the at least two layers of shingle material together wherein said shingle comprises a tab portion adapted to be exposed in the installed condition and a headlap portion adapted to be covered in the installed condition, said tab and headlap portions meeting together at a mutual junction, and wherein said two layers of shingle material are present in at least the tab portion of the shingle, with the tab portion of the shingle having opposite side edges and a lower edge connected at shingle lower corners, and wherein visual means are provided to define the junction of said tab portion and headlap portion along at least one side edge of the tab portion of the shingle, for visually aligning an associated lower corner of a next-overlying shingle with said visual means of an overlain shingle.

16. The shingle of claim 15, wherein said visual means comprises a locating zone at an uppermost location of a reduced width of tab of the upper layer of shingle material relative to the headlap of said upper layer of shingle material.

17. The shingle of claim 16, wherein said locating zone of said upper layer and said lower corner of the shingle at the same side edge of the tab portion are of the same configuration.

18. The shingle of claim 17, wherein said configuration is of parallel, sloped lines.

19. A hip or ridge shingle of generally flat configuration prior to installation and adapted to be bent or curled into an at least partially arcuate configuration in its installed condition, said shingle being comprised of a base mat with a covering of asphaltic material applied thereto and a covering of granules applied to the asphaltic material, wherein said shingle comprises a tab portion adapted to be exposed in the installed condition and a headlap portion adapted to be covered in the installed condition, said tab and headlap portions meeting together at a mutual junction, with the tab portion of the shingle having opposite side edges and a lower edge connected to define shingle lower corners, and wherein visual means are provided at the junction of said tab portion and headlap portion along at least one side edge of the tab portion of the shingle, for visually aligning an associated lower corner of a next-overlying shingle with said visual means of an overlain shingle.

20. The shingle of claim 19, wherein said visual means comprises a locating zone at an uppermost location of a reduced width of tab portion relative to the headlap portion.

21. The shingle of claim 20, wherein said locating zone and said lower corner of the shingle at the same side edge of the tab portion are of the same configuration.

* * * * *